United States Patent [19]

Bacehowski et al.

[11] 4,389,206

[45] Jun. 21, 1983

[54] CENTRIFUGAL PROCESSING APPARATUS AND ROTATABLE PROCESSING BOWL APPARATUS

[75] Inventors: David V. Bacehowski, Wildwood; Michael J. Brown, Libertyville, both of Ill.

[73] Assignee: Baxter Travenol Laboratories, Inc., Deerfield, Ill.

[21] Appl. No.: 243,981

[22] Filed: Mar. 16, 1981

Related U.S. Application Data

[63] Continuation-in-part of Ser. No. 195,445, Oct. 9, 1980, abandoned.

[51] Int. Cl.[3] ..... B04B 11/00

[52] U.S. Cl. ..... 494/42

[58] Field of Search ..... 233/1 R, 16, 21, 25, 233/26, 27; 128/214 R; 494/18, 42, 85

[56] References Cited

U.S. PATENT DOCUMENTS

| | | | |
|---|---|---|---|
| Re. 29,738 | 8/1978 | Adams . | |
| 2,471,224 | 5/1949 | Loughborough . | |
| 3,034,509 | 5/1962 | Berstein et al. . | |
| 3,411,981 | 11/1968 | Thomas . | |
| 3,428,707 | 2/1969 | Amos et al. . | |
| 3,730,931 | 5/1973 | Simoneau et al. . | |
| 3,790,510 | 2/1974 | Flannigan . | |
| 3,795,634 | 3/1974 | Nielsen . | |
| 3,798,189 | 3/1974 | Simoneau et al. . | |
| 3,885,735 | 5/1975 | Westbert | 233/25 |
| 3,945,955 | 3/1976 | Ihde, Jr. . | |
| 3,986,442 | 10/1976 | Khoja | 74/797 |
| 4,056,224 | 11/1977 | Lolachi | 233/26 X |
| 4,082,217 | 4/1978 | Westberg | 233/25 |
| 4,108,353 | 8/1978 | Brown | 233/26 |
| 4,109,852 | 8/1978 | Brown et al. | 233/26 X |
| 4,109,855 | 8/1978 | Brown et al. | 233/25 |
| 4,111,356 | 9/1978 | Boggs et al. | 233/26 |
| 4,113,173 | 9/1978 | Lolachi | 233/25 |
| 4,127,231 | 11/1978 | Khoja et al. | 233/1 R |
| 4,132,349 | 1/1979 | Khoja et al. | 233/25 |
| 4,146,172 | 3/1979 | Cullis et al. | 233/26 |
| 4,151,844 | 5/1979 | Cullis et al. | 128/214 R |
| 4,163,519 | 8/1979 | Stabile | 233/26 |
| 4,164,318 | 8/1979 | Boggs | 233/26 |
| 4,177,182 | 12/1979 | Ichikawa et al. . | |
| 4,191,182 | 3/1980 | Popovich et al. | 128/214 R |
| 4,194,684 | 3/1980 | Boggs | 233/26 |
| 4,198,363 | 4/1980 | Noel . | |
| 4,216,770 | 8/1980 | Cullis et al. | 128/214 R |
| 4,230,263 | 10/1980 | Westberg | 233/27 X |
| 4,299,256 | 11/1981 | Bacehowski et al. | 138/141 X |

FOREIGN PATENT DOCUMENTS

| | | |
|---|---|---|
| 998480 | 4/1976 | Canada . |
| 2717344 | 11/1977 | Fed. Rep. of Germany . |
| 691628 | 5/1953 | United Kingdom . |
| 1529574 | 10/1978 | United Kingdom . |

OTHER PUBLICATIONS

Y. Ito, J. Suaudeau, and R. L. Bowman, "New Flow Through Centrifuge Without Rotating Seals Applied to Plasmapheresis", Science, 189, No. 4207, p. 999, 9/19/75.

R. F. Stengel, "Cable Connects to Rotating Platform Without Slip Rings", Design News, 1/22/73.

Dow Corning Corporation Bulletin 05-011, Apr. 1962, "Silicone Notes: Silicones in Plastisols".

Dow Corning Corporation, "Product/Applications, Guide to Dow Corning Silicones", p. 13, (Plastisol Additives), Copyright 1962.

*Primary Examiner*—Philip R. Coe

*Attorney, Agent, or Firm*—Paul C. Flattery; Garrettson Ellis; Daniel D. Ryan

[57] ABSTRACT

A rotatable processing bowl-type apparatus for separating blood components where a plurality of flexible umbilical tubes are positioned to establish communication with a processing bowl at one end thereof. Certain segments of each of the cables are stiffer than other segments of the same cables for improved life and performance. Also, outer portions of portions of the cables are impregnated with silicone oil.

32 Claims, 5 Drawing Figures

CENTRIFUGAL PROCESSING APPARATUS AND ROTATABLE PROCESSING BOWL APPARATUS

CROSS-REFERENCE TO RELATED APPLICATION

This application is a continuation-in-part of U.S. Application Ser. No. 195,445, filed Oct. 9, 1980, now abandoned.

TECHNICAL FIELD

Centrifugal blood processing is a growing field, permitting the continuous removal of blood from a patient, following by centrifugal separation of the blood into components, collection of some of the components, and commonly readministration of other of the components to the patient.

For example, patients having leukemia may be treated by the removal of white cells from their blood, while at the same time readministering the red cells and plasma by means of a centrifugal cell separating apparatus, particularly the CELLTRIFUGE® cell separating apparatus, sold by the Instrument Division of Travenol Laboratories, Inc.

Alternatively, other blood processes such as plasmapheresis or the removal of packed red cells or platelets may be effected by means of a centrifugal separator.

Furthermore, many other uses for centrifugal separation are known, apart from its use in the separation of blood into components.

BACKGROUND ART

Above and beyond the well-known CELLTRIFUGE separator as described above, other blood separation devices are disclosed in Khoja et al. U.S. Pat. No. 4,132,349; Cullis et al. U.S. Pat. No. 4,151,844; and Khoja et al. U.S. Pat. No. 4,127,231. In each of these patents, a centrifugal liquid processing apparatus is disclosed utilizing a bowl, with tubing communicating directly with the bowl and fixed at its other end. Twisting of the tubing during operation may be avoided as described in Adams U.S. Pat. No. 3,686,413 and also U.S. Pat. No. 3,986,442.

Difficulties, however, arise during the centrifugal process due to the high rate of centrifugal rotation, which imparts vigorous stresses and strains onto the centrifugal tubing both due to the twisting action of the tubing and also due to the G-stresses, particularly on the areas of the tubing which are positioned in a radially outward position where the G-stresses of centrifugation are maximized.

Such twisting can actually abrade and destroy the structural integrity of portions of the tubing during the centrifugal operation which, of course, must be avoided.

One solution is utilized in Boggs U.S. Pat. No. 4,164,318, in which a multiple lumen umbilical cable is utilized in place of multiple tubing, and in which the cable is stretched to exhibit a reduced diameter at its radially outward portions, so that the reduced mass of the radially outward portions of the tubing exerts less violent stress and strain upon the material of the tubing.

In accordance with this invention, a centrifugal processing apparatus and its processing bowl assembly may be equipped with separate, flexible, umbilical tubes which are constructed in a particular manner in accordance with this invention for greatly increased lifetime under centrifugal conditions, to permit long-term high RPM centrifugal separation operations without a significant concern of excessively abrading or rupturing the tubes.

DISCLOSURE OF INVENTION

In accordance with this invention, a centrifugal processing apparatus is provided including a stationary base and a rotatable processing bowl mounted with respect to the base for rotation about a predetermined axis. The bowl has conduit means variably radially positioned to inject a material for centrifugation into the processing bowl and to pick up various centrifugally separated components of the material during centrifugation.

A plurality of flexible, umbilical tubes are positioned to establish communication with the processing bowl at one end thereof, with the plurality of umbilical tubes communicating with said conduit means and extending axially from one end of the processing bowl in a first segment, extending radially outwardly from the axis of rotation in a second segment connected to the first segment, extending in a direction generally longitudinal of the axis of rotation in a third segment connected to the second segment; and extending again to the axis of rotation and being fixedly retained thereon relative to said base in a fourth segment connected to the third segment.

The first and fourth segments, i.e., the end segments, of at least a plurality of the umbilical cables preferably have a shear modulus of 500 to 700 psi. and a loss modulus of 80 to 200 psi., as determined by the ASTM Test D 2236. Thus, the first and fourth (or end) segments are relatively resilient.

The second and third segments, which are generally the middle segments, preferably exhibit a shear modulus of 800 to 1400 psi. and a loss modulus of 250 to 400 psi., as determined by the above-cited test. Thus these segments of the umbilical tubes are stiffer than the first and fourth segments, for stability of movement during centrifugation and inhibition of tubing fatigue and collapse.

It is also preferred for the second and third segments to be of less outer diameter in weight per unit of length than the first and fourth segments to reduce the high G-stresses on these segments which are typically positioned at radially outer positions relative to most of the length of the first and fourth segments.

It is also preferable for at least the first segment to include a cylindrical outer section thereof of at least 0.025 cm. thickness which contains from 1 to 5 percent of a silicone oil uniformly distributed therethrough. The segment may comprise a polyvinyl chloride plastic material. The first segment also includes an inner, cylindrical section telescopically positioned within the outer, cylindrical section, the inner cylindrical section being essentially free of silicone oil. Such tubing may be made in accordance with the Bacehowski et al, U.S. Pat. No. 4,299,256 which is incorporated herein by reference. Preferably, the inner cylindrical section has at least twice the radial thickness of the outer cylindrical section.

It may be desirable for the umbilical tubes to be positioned during operation in a J-shaped tubular retention member, coupled with means for rotating the J-shaped retention member in the direction of rotation of the rotational bowl at one-half the rotational rate thereof, to take advantage of the known principle for rotating a centrifugal member connected to tubing which is stationary at its other end without twisting of the tubing.

If desired, the plurality of flexible umbilical tubes may be braided or twisted together so that they move in their operation as a single unit.

DESCRIPTION OF SPECIFIC EMBODIMENT

Figures 1, 3, 4:
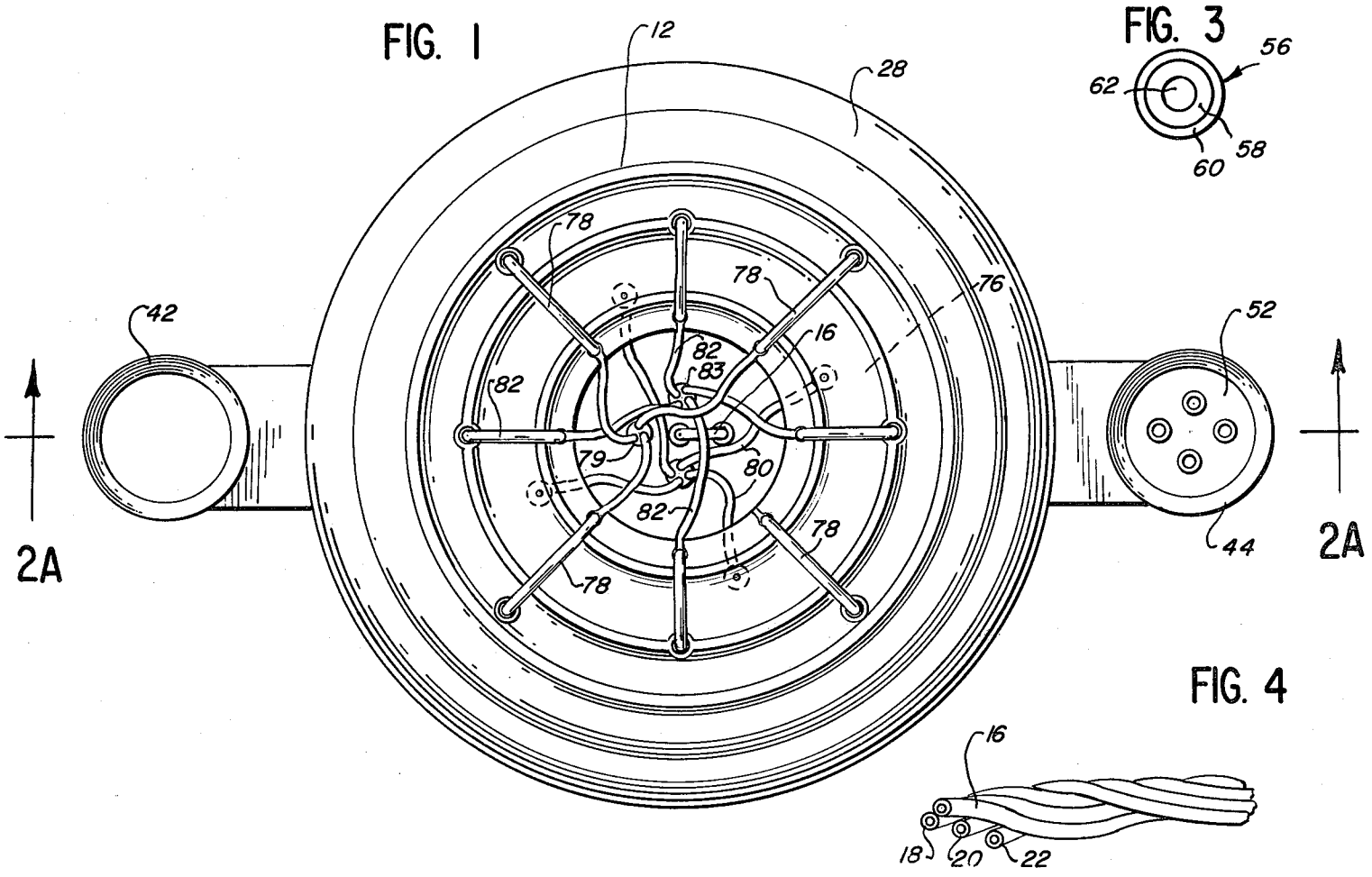
FIG. 1 is a plan view, with portions broken away, of the centrifugal processing apparatus in accordance with this invention.
FIG. 3 is a cross sectional view of the above-described double layered tubing of the first segment.
FIG. 4 is a fragmentary, elevational view of the umbilical tubes used herein in coiled form.

Referring to the drawings, a blood centrifuge 10, positioned on a generally stationary base 14, is disclosed which carries a disposable, rotatable processing bowl 12.

A plurality of flexible, umbilical tubes 16, 18, 20 22 communicate with processing bowl 12 at one end thereof as shown.

Centrifugal processing apparatus 10 may operate in accordance with generally known principles, being driven by sprocket, by a belt or chain drive to rotate shaft 26.

Shaft 26, in turn, carries receptacle 28 for rotation, which, in turn, receives rotatable processing bowl 12, which preferably may be a removable and disposable member, being replaced with each separate blood processing procedure. Outer shell 38 is also carried on shaft 26.

Belt-connected gear reducer bearing 29 rotates with shaft 26, with belt 30 communicating with a gear system which is not shown and is of conventional design. Belt 32 connects to the gear system and rotational bearing 36, and rotates outer shell 38, through rotating arm 34 and retention member 40, at one-half the rotational velocity of shaft 26 and receptacle 28.

J-shaped tubings 42 and 44 are provided on outer shell 38, with J-shaped tubing 44 being positioned to receive the umbilical tubings 16 through 22, and the other J-shaped tubing 42 being used as a counterbalance.

J-shaped tubular retention means 44 may have an inner tubular coating 45 of ultra high molecular weight polyethylene, a commercially available material, on its inner surface for reduced friction and noise reduction as the umbilical tubes move within the retention means. Specifically the ultra high molecular weight of the polyethylene should be at least one million or above.

The above drive system as described may be similar to that of the previously cited U.S. Pat. No. 4,132,349.

Rotatable processing bowl 12 is shown to define an inner wall 46 and a spaced outer wall 48, between which a flow passage 50 is defined. As shown, tubings 16 through 22 communicate at one end with the passage 50 of bowl 12, and extend through a plug member 52 which surrounds each of tubings 16 through 22, and is positioned by retention bracket 54 about the axis of rotation of bowl 12.

Figure 2A:
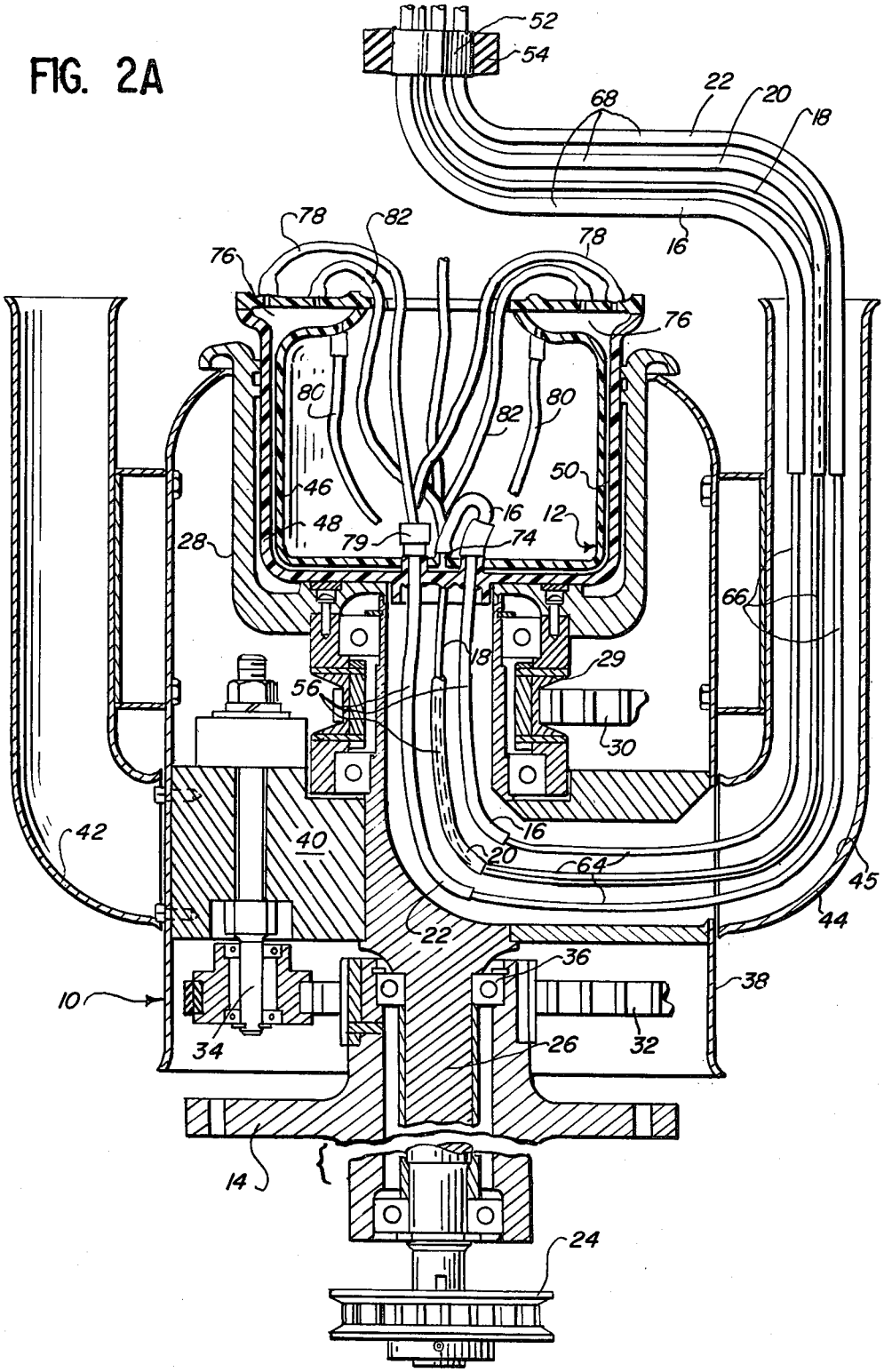
FIG. 2A is a vertical sectional view, taken along line 2A—2A of FIG. 1.
Figure 2B:
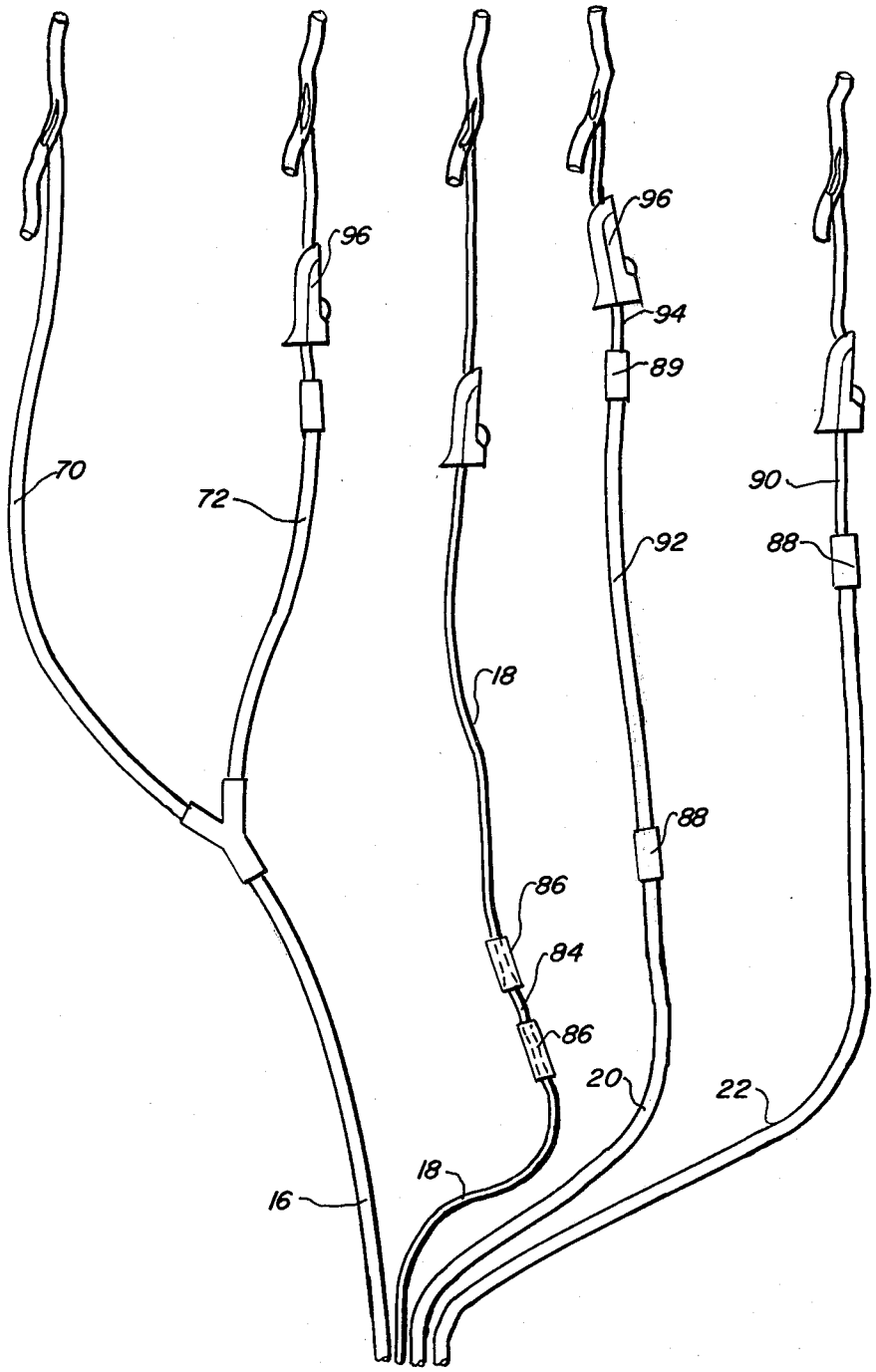
FIG. 2B is an elevational view showing the further extensions of the four umbilical tubes of FIG. 2A which are cut off at the top of FIG. 2A.

The remaining portions of tubings 16 through 22 are as disclosed in FIG. 2B, and may extend to any length desired to communicate with various containers or with the patient. For purposes of this invention, the specific structure and composition of the sections of tubes 16 through 22 as depicted in FIG. 2B is not critical, while specific structural features of the tubings as they extend between plug 52 and bowl 12 provide advantages of this invention.

As shown, tubings 16, 20 and 22 define first segments 56 which extend axially relative to the axis of rotation from one end of the processing bowl to a second segment. To be particularly resistant to the violent stresses and strains to which the tubing is subjected, first sections 56 of tubings 16, 20, and 22 are made of a material, for example polyvinyl chloride plasticized with an ester plasticizer such as di-2-ethylhexylphthalate, which is relatively resilient, and thus resistant to the violent forces of twisting and bending which it encounters during centrifugal processing. Specifically, sections 56 of the umbilical tubes may have a shear modulus between 500 and 700 psi. and a loss modulus of 80 to 200 psi. as determined by ASTM D 2236. Specifically, the shear modulus may be 600 psi. and the loss modulus 100 psi.

Furthermore, segments 56 may be of relatively enlarged outer diameter to central segments of umbilical tubes 16, 20, 22, and may include a cylindrical outer section 60 thereof of at least 0.025 cm. thickness which contains from 1 to 5 percent of a silicone oil such as dimethylpolysiloxane uniformly distributed therethrough. As shown in FIG. 3, segments 56 also include an inner cylindrical section 58, telescopically positioned within the outer cylindrical section 60, with the inner cylindrical section being essentially free of silicone oil. As stated above, such tubing may be made by the high-shear mixing of about 3 percent by weight of silicone oil in powdered polyvinyl chloride plastic, to obtain a uniform dispersion of the silicone within the plastic, as described in the previously-cited patent application. Following this, the tubing may be coextruded, with the silicone-containing plastic layer 60 as the outer portion 60, and a silicone-free polyvinyl chloride plastic being extruded as the inner portion. Alternatively, other materials may be utilized in the same manner, for example, the block copolymer sold as HYTREL by DuPont.

It is generally preferred for the inner cylindrical section 58 to have at least twice the radial thickness of the outer cylindrical section 60 for both cost saving, and to insure that liquid silicone does not get into the bore 62 of tubing segments 56.

Preferably, outer portion 60 may be on the order of 0.06 to 0.08 cm. thickness, to provide a constantly lubricated surface during the centrifugal operations which can not wear away, since as plastic material is worn away new silicone oil is exposed to the surface preventing catastrophic wear and destruction of the tubing segment 56 in their particular location as shown in FIG. 2A, where frictional stresses of twisting and abrasion are very high.

Umbilical tubings 16, 20, and 22 each define second segments 64, which may be solvent sealed to first segments 56, which extend radially outwardly of the axis of rotation as shown in FIG. 2A.

Segments 64 may be integral with third segments 66 of tubings 16, 20, and 22, which extend in a direction generally longitudinal of the axis of rotation, being positioned in the specific embodiment within J-shaped tubing 44, although J-shaped tubing 44 is not absolutely necessary for operation in accordance with this operation.

Segments 64 and 66 may be of less outer diameter than segments 56, but are typically of the same inner diameter.

Segments 64 and 66 are desirably stiffer than segment 56, preferably having a shear modulus of 800 to 1400 psi. and a loss modulus of 250 to 400 psi. as treated in the manner described above. Specifically, segments 64 and 66 may each have a shear modulus of about 1100 psi. and a loss modulus of about 360 psi.

Umbilical tubes 16, 20, and 22 also each have a fourth segment 68, which may be solvent sealed to the third segments 66, and which extend again to the axis of rotation and pass through plug 52, then extending to the ends of respective tubings. Segments 68 may be of the same enlarged outer diameter, relative to segments 64, 66, as are segments 56, and they may be constructed with a silicone-containing outer layer in the manner of segments 56. However, they may also be merely coated with a coating of silicone oil since often stresses and abrasion encountered by segments 68 are not as severe as segments 56 so that a simple coating of silicone may suffice in the latter instance, while for segments 56 it is preferable for a deeper composite silicone oil-containing layer to be provided in order to avoid catastrophic wear of segments 56 during centrifugal operations.

Preferably, segments 56 and 68 have an outer diameter of 0.250 inch (0.635 cm.) and an inner diameter of 0.125 inch (0.406 cm.). Segments 64 and 66 have an outer diameter of 0.16 inch (0.406 cm.) and an inner diameter of 0.09 inch (0.229 cm.).

Segments 68 should be of a relatively resilient characteristic similar to the composition of segments 56, having similar range of shear and loss modulus.

Accordingly, in the process of this invention, blood enters umbilical tubing 16 through branch line 72, being supplied through a conventional blood bag or directly from the patient. Sterile saline solution or the like may be administered as needed through branch line 72 to wash the blood out of the apparatus at the end of the operation, and also to prime the apparatus prior to administration of blood. Line 70 is a pressure monitor line.

The blood passing through umbilical tube 16 enters into bowl 12, looping downwardly through port 74 to enter bowl-shaped space 50. As the bowl 12 rotates in the centrifugal apparatus 10, twisting of umbilical tubes 16 through 22 is avoided in accordance with known principles by the half-speed rotation of outer shell 38. At the same time, blood migrates in bowl-shaped space 50 upwardly into enlarged annular chamber 76.

Due to the centrifugal action, red cells migrate outwardly on a continuous basis, to be collected through peripherally outermost collection conduits 78. These lines 78, in turn, connect through multiple connector 79 with umbilical line 22, for withdrawing red cells from bowl 12 for reinfusion to the patient or collection and storage.

Radially inwardmost conduits 80, in turn, are adapted for collecting blood plasma which accumulates at the radially inner portions of annular chamber 76, with conduits 80 communicating into chamber 76 from its inner side, in distinction to conduits 78. Conduits 80 are all connected together in a multiple manifold connector similar to connector 79, to connect with tubing 20, which thus serves as a plasma collection line. Plasma may be collected in containers which are connected to the free end of tubing 20 as in a plasmapheresis operation or, alternatively, the plasma may be reinfused to the patient.

Finally, conduits 82 communicate with annular, enlarged chamber 76 at a radial position between conduits 78 and 80. The purpose of conduits 82 is to collect the buffycoat layer of white cells and platelets which forms between the red cell and plasma layers upon centrifugal operation. Conduits 82 connect with umbilical tubing 18 through multiple manifold connector 83.

Umbilical tube 18 is different from tubes 16, 20, 22 in that it does not exhibit a differential thickness, but is preferably of the same outer diameter along its length from bowl 12 to plug 52, having a thicker wall than the other umbilical tubes and a smaller inner diameter, for example an outer diameter of 0.186 inch (0.472 cm.) and an inner diameter of 0.062 inch (0.157 cm.).

The advantage of utilizing a tube for platelet and white cell collection which has a smaller inner diameter is that it accordingly contains less volume, and the collection of the white cells can thus be monitored in an interface controller device of known design, similar to that utilized in the CS 3000 blood cell separator, sold by Travenol Laboratories, Inc. A section of tubing 84 of larger bore diameter than the remaining tubing 18 is placed in the interface controller. Connectors 86 may have a tapered inner diameter to provide smooth laminar flow between the section of tubing 84 of larger bore diameter and the adjacent sections of tubing 18 of smaller bore diameter.

Similarly tapered connector 88 may connect tubing 22 of relatively enlarged diameter with end tubing section 90 of smaller diameter, if desired. Tubing 20 may be connected by connectors 88 to a length of tubing 92, and then a terminal length of tubing 94 of smaller inner diameter may be added on by connector 89. The length of tubing 92 may be utilized in a roller pump, for example, for control of plasma outflow which, in turn, can control the level of the radial position of the buffy-coat layer in annular chamber 76 for proper collection thereof. Connector 88 serves to position tube 90 in the pump.

Most of the umbilical tubes carry roller clamps 96 or similar clamps for controlling flow therethrough.

Accordingly, the device of this invention provides an improved system for separating blood or other materials into their various components, with the flexible umbilical tubes being capable of withstanding longer centrifugal operation at higher G force without excessive wear or abrasion, while at the same time taking advantage of the remarkable advantages which accrue from having the umbilical tubes communicate with a rotating bowl at one end and to a fixed site or sites at the other end. As stated above, the tubings 16 through 22 may be coiled or braided.

The above has been offered for illustrative purposes only, and is not intended to limit the invention of this application, which is as defined in the claims below.

That which is claimed is:

1. A centrifugal processing apparatus comprising a stationary base, a rotatable processing bowl mounted on said base for rotation about an axis, and a plurality of flexible umbilical tubes communicating with said processing bowl to inject a material into said bowl for centrifugation and for removing various centrifugally separation fractions of said material from said bowl, said plurality of umbilical tubes extending from said processing bowl along the axis of rotation of said bowl in a first segment; thence extending radially outwardly of the axis of rotation in a second segment connected to the first segment; thence extending in a direction generally axially of the axis of rotation in a third segment connected to the second segment; and thence extending to a fixed position along the axis of rotation in a fourth segment connected to the third segment; said first and fourth segments of a plurality of said plurality of umbilical tubes having a shear modulus of 500 to 700 psi and a loss modulus of 80 to 200 psi., and said second and third segments having a shear modulus of 800 to 1400 psi. and a loss modulus of 250 to 400 psi.

2. A centrifugal processing apparatus according to claim 1 wherein at least said first segment includes an outer section which contains silicone oil, said first segment also including an inner section within said outer section, said inner section being essentially free of silicone oil.

3. A centrifugal processing apparatus according to claim 2 wherein said inner section has at least twice the radial thickness of said outer section.

4. A centrifugal processing apparatus according to claim 1 and further including tubular retention means for receiving said umbilical tubes and means for rotating said retention means in the direction of rotation of said rotatable bowl at one-half the rotational rate thereof.

5. A centrifugal processing apparatus according to claim 4 wherein said tubular retention means includes an ultra high molecular weight polyethylene inner surface.

6. A centrifugal processing apparatus according to claim 1 wherein said second and third segments are of less outer diameter and weight per unit of length than said first and fourth segments.

7. A centrifugal processing apparatus according to claim 1 and further including an additional umbilical tube communicating with said bowl and having a smaller inner diameter and a thicker wall than any of said first-mentioned plurality of umbilical tubes.

8. A centrifugal processing apparatus according to claim 1 or 7 wherein said processing bowl includes wall means for forming an annular chamber radially spaced about the rotational axis of said bowl, and wherein one of said first-mentioned umbilical tubes is operative for introducing fluid into said annular chamber and the remaining umbilical tubes are operative for withdrawing fractions of the fluid from said annular chamber during centrifugation.

9. A centrifugal processing apparatus according to claim 1 or 7 wherein said plurality of flexible umbilical tubes are coiled together in a helical array.

10. A rotatable processing bowl assembly adapted for mounting in a centrifuge and comprising a rotatable processing bowl, and at least one flexible umbilical tube communicating with said processing bowl and including spaced segments, one of said spaced segments being positioned generally adjacent to said rotatable processing bowl and the other one of said spaced segments being positioned generally adjacent to the opposite end of said umbilical tube, each of said spaced segments having a shear modulus of 500 to 700 psi. and a loss modulus of 80 to 200 psi., said umbilical tube also including a middle segment positioned between said spaced segments and having a shear modulus of 800 to 1400 psi. and a loss modulus of 250 to 400 psi.

11. A rotatable processing bowl assembly according to claim 10 wherein said spaced segment adjacent to said processing bowl includes an outer section which contains a silicone oil, said segment also including an inner section within said outer section, said inner cylindrical section being essentially free of silicone oil.

12. A rotatable processing bowl assembly according to claim 11 wherein said inner section has at least twice the radial thickness of said outer section.

13. A rotatable processing bowl assembly according to claim 10 wherein said middle segment is of less outer diameter and weight per unit of length than either of said spaced segments.

14. A rotatable processing bowl assembly according to claim 10 or 11 or 12 or 13 wherein a plurality of said flexible, umbilical tubes communicate with said processing bowl.

15. A rotatable processing bowl assembly according to claim 14 and further including an additional umbilical tube communicating with said processing bowl and having a smaller inner diameter and a thicker wall than said first-mentioned umbilical tube.

16. A rotatable processing bowl assembly according to claim 15 wherein said processing bowl includes wall means for forming an annular chamber radially spaced about the rotational axis of said bowl, and wherein one of said first-mentioned umbilical tubes is operative for introducing fluid into said annular chamber and the remaining umbilical tubes are operative for withdrawing fractions of the fluid from said annular chamber during centrifugation.

17. A rotatable processing bowl assembly to claim 16 wherein said remaining umbilical tubes communicate with said annular chamber at successive radial distances from the rotational axis of said bowl for each removing different fluid fractions from said chamber.

18. A rotatable processing bowl assembly according to claim 14 wherein said plurality of umbilical tubes are coiled together in a helical array.

19. A centrifugal processing apparatus according to claim 1 wherein the shear modulus of said first and fourth segments is about 600 psi. and the loss modulus of said first and fourth segments is about 100 psi.

20. A centrifugal processing apparatus according to claim 1 or 19 wherein the shear modulus of said second and third segments is about 1100 psi. and the loss modulus of said second and third segments is about 360 psi.

21. A rotatable processing bowl assembly according to claim 10 wherein the shear modulus of said spaced portions is about 600 psi. and the loss modulus of said spaced portions is about 100 psi.

22. A rotatable processing bowl assembly according to claim 10 or 21 wherein the shear modulus of said middle segment is about 1100 psi. and the loss modulus of said middle segment is about 360 psi.

23. An umbilical tubing system adapted to communicate with a rotatable processing bowl of a centrifuge and comprising oppositely spaced segments, one of which is positioned generally adjacent to the processing bowl and the other of which is positioned generally adjacent the opposite end of said tubing system, said spaced segments being generally resilient to the forces of twisting encountered during centrifugation, and a middle segment positioned between said spaced segments and having a shear modulus which exceeds the shear modulus of either of said spaced segments for greater stiffness to inhibit tube fatigue and collapse during centrifugation.

24. A tubing system according to claim 23 wherein said spaced segments each has a shear modulus of generally between 500 and 700 psi. and a loss modulus of generally between 80 and 200 psi., and wherein said middle segment has a shear modulus of generally between 800 and 1400 psi. and a loss modulus of generally between 250 and 400 psi.

25. A tubing system according to claim 24 wherein the shear modulus of said spaced portions is about 600 psi. and the loss modulus of said spaced portions is about 100 psi.

26. A tubing system according to claim 24 or 25 wherein the shear modulus of said middle segment is about 1100 psi. and the loss modulus of said middle segment is about 360 psi.

27. A tubing system according to claim 23 or 24 wherein said middle segment is of less outer diameter and weight per unit of length than either of said spaced segments.

28. A tubing system according to claim 23 or 24 wherein said tubing system includes a plurality of individual tubes, a plurality of which include said spaced and middle segments.

29. A tubing system according to claim 28 wherein said plurality of umbilical tubes are coiled together in a helical array.

30. A tubing system according to claim 23 or 24 wherein said spaced segment adjacent to the processing bowl includes an outer section which includes silicone oil.

31. A tubing system according to claim 30 wherein said spaced segment adjacent to the processing bowl includes an inner section which is disposed within said outer section and which is essentially free of silicone oil.

32. A tubing system according to claim 23 or 24 wherein said spaced segment adjacent to the end of said tubing system includes an outer section which includes silicone oil.

* * * * *